US006010332A

United States Patent [19]

Lee et al.

[11] Patent Number: 6,010,332

[45] **Date of Patent: *Jan. 4, 2000**

[54] DISPOSABLE LIQUID FUEL BURNER

[75] Inventors: Richard H. Lee, San Antonio; Ernesto E. Jergins, New Braunfels; Robert J. Blankenship, Magnolia, all of Tex.

[73] Assignee: Heat-It Manufacturing, Inc., San Antonio, Tex.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/734,932

[22] Filed: Oct. 22, 1996

Related U.S. Application Data

[63] Continuation of application No. 07/613,635, Sep. 21, 1992, Pat. No. 5,567,146, which is a continuation-in-part of application No. 07/197,510, May 23, 1988, Pat. No. 4,850,858.

[51] Int. Cl.[7] ..... F23D 3/24

[52] U.S. Cl. ..... 431/320; 431/298; 431/325; 126/43; 126/45

[58] Field of Search ..... 431/320, 323, 431/298, 325; 126/43, 44, 45, 46, 49, 50, 261, 262, 263, 265, 266; 220/269

[56] References Cited

U.S. PATENT DOCUMENTS 211,223 1/1879 Chase ..... 431/323
3,262,290 7/1966 Huber .
4,850,858 7/1989 Blankenship et al. ..... 431/320
5,567,146 10/1996 Blankenship et al. ..... 431/320

FOREIGN PATENT DOCUMENTS 834012 11/1938 France ..... 126/263

*Primary Examiner*—Carl D. Price
*Attorney, Agent, or Firm*—Kammer & Huff, PLLC

[57] ABSTRACT

A disposable fuel burner 10 is disclosed which comprises a container 11 having a closed bottom wall 12, an enclosing sidewall 13 and an open top 14, and at least partially filled with a liquid fuel 15. A support member 16 is supported adjacent the open top 14 above the fuel 15, and having a centrally located opening 17 of various diameters for receiving one end of an elongated wick 18 of a fibrous material. The support member 16 may be a cardboard or plastic disk supported on legs 21*a*, a cylinder 21, or may be a cup-shaped member 30. A first layer of fibrous material 22 substantially fills the open top 14 and overlies the support member and the end of the wick supported thereon and acts as an interface between the fuel 15 and the atmosphere. A second layer of a plastic 23, e.g., polyurethane, foam material overlies the first layer. A top cover 27 is secured on the container 11 closing the open top 14 and is at least partially removable, e.g., removable cover or pull-tab opening cover, to expose the plastic foam layer 23, whereby the burner may be ignited with the flame extending substantially uniformly from said entire top opening 26 and continuing to burn until extinguished or said fuel 15 is exhausted. The plastic foam layer 23 is combustible and burns off in use with the flame being subsequently emitted from the surface of said fibrous layer 22. A flat disc or ring member 124 with an opening 125 smaller than the lid 27*a* is provided to control the size of the flame and rate of burning.

4 Claims, 5 Drawing Sheets

DISPOSABLE LIQUID FUEL BURNER

This is a continuation of application Ser. No. 07/613,635, filed Sep. 21, 1992, now U.S. Pat. No. 5,567,146, which is a continuation-in-part of application Ser. No. 07/197,510, filed May 23, 1988, now U.S. Pat. No. 4,850,858.

FIELD OF THE INVENTION

This invention relates generally to a disposable fuel burner and more particularly a burner having spill proof characteristics.

BACKGROUND OF THE INVENTION

Restaurants and other food preparers and servers have long required simple means for heating or maintaining foods at an elevated temperature for extended periods of time. The need has been particularly strong for buffet service or for table service where some items are kept hot at the table. However, such heating means have been subject to criticism as fires start and spread when they are tipped over. There has been a need for a liquid fuel burner that has a spill proof design.

Canisters containing jellied fuels, under the name CANNED HEAT, have been in use for many years. CANNED HEAT is the registered trademark of CPL Industries. Canisters with liquid fuels are also used. At first volatile alcohol fuels were used, but more recently fuels of low volatility, such as glycols, have come into use. The usual liquid fuel burner has a wick which concentrates the flame into a small area. There has been a need for a fuel burner having a construction which spreads the flame over a substantial area for a less concentrated application of heat, and for a fuel burner that will not spill its fuel in cases of accidental tip-over.

Devon—U.S. Pat. No. 3,888,620—discloses a canned burner using a wax fuel and having a tubular wick which protrudes above the can at several points.

Huber—U.S. Pat. No. 3,262,290—discloses a canned burner using a liquid fuel and a wick stone.

De la Rosa—U.S. Pat. No. 4,604,053—discloses a canned burner using a liquid fuel and having a flat wick which protrudes above the can through an opening so that the middle portion of the wick is exposed and the ends are positioned in the liquid fuel.

Bandel—U.S. Pat. No. 4,624,633—discloses a canned burner using a liquid fuel and having a central wick which protrudes above the can through a center opening. Glycol fuels are claimed as the novel feature.

Menter—U.S. Pat. No. 4,611,986—discloses a canned burner using a liquid fuel and having a central flat folded wick which protrudes above the can through a center opening.

Norwegian Patent No. 59,224 and British Patent No. 845,639 disclose liquid fuel burners with special wick constructions.

The present invention relates to a fuel burner capable of retaining its liquid fuel therein in case of accidental tip-over, which prevents the spread of fire. In particular, the present invention relates to container having a closed bottom, an enclosing side wall and an open top, at least partially filled with a layer of fibrous material, at least partially saturated in a liquid fuel, which fibrous layer can officially transmit the liquid fuel to the burning surface at the top opening of the container, but which fibrous layer will significantly impede the flow of liquid in response to gravitation, such as in an accidental tip-over.

Present invention also relates to a fuel burner capable of supporting combustion above a liquid fuel soaked fibrous material, which material will not itself burn, at least not while liquid fuel is still being consumed.

The present invention is also distinguished from this and other prior art by a disposable fuel burner which comprises a container having a closed bottom, an enclosing sidewall and an open top and at least partially filled with a fuel. A support member is supported adjacent the open top above the fuel and having a centrally located opening receiving one end of an elongated wick of a fibrous material, e.g., cotton or glass fibers, overlying the support member and having its other end immersed in the fuel. The support member may be flat and made of a cardboard or plastic disk supported on legs or a cylinder or may be a cup-shaped member. A fibrous layer is located on the support member and is capable of retaining fuel therein and capable of supporting combustion at the surface thereof while also being able to contain such liquid or jellied fuel in the event of an accidental tip-over substantially fills the container. In the alternative, a non-combustible material, e.g., glass fibers, substantially fills the open top and overlies the support member and the end of the wick supported thereon. A layer of a plastic, e.g., polyurethane, foam material overlies the fibrous layer. A top cover is secured on the container closing the open top and is at least partially removable, e.g., removable cover or pull-tab opening cover, to expose the layer of plastic foam, whereby the burner may be ignited with the flame extending substantially uniformly from said entire top opening and continuing to burn until extinguished or said fuel is exhausted. The plastic foam layer is combustible and burns off in use with the flame being subsequently emitted from the surface of said fibrous layer.

SUMMARY OF THE INVENTION

It is therefore a general object of this invention to provide a new and improved portable burner for cooking, for heating or for maintaining food hot at a point of service.

It is another object of the present invention to provide a new and improved portable liquid or jellied fuel burner for cooking, for heating or for maintaining food hot at a point of service.

It is an other object of this invention to provide a new and improved portable fuel burner for cooking, or heating, or maintaining hot food at a point of service and having a design permitting liquid or jelled fuel to be maintained within the burner even during accidental tip-over, thereby preventing the spread of a flame.

It is another object of this invention to provide a new and improved portable fuel burner for cooking, for heating or for maintaining food hot at a point of service and having a construction permitting generation of a flame spread over a substantial area.

It is another object of this invention to provide a new and improved portable liquid fuel burner for cooking, for heating or for maintaining food hot at a point of service and having a construction permitting generation of a flame spread over the entire top of the can in which the fuel is carried and stored.

It is another object of this invention to provide a disposable fuel burner with an integral sleeve to support a cooking pot thereon and control draft to the flame of the burner.

It is another object of this invention to provide for a fuel burner that maintains a flat base and level flame to the cooking surface throughout its burn time.

It is another object of this invention to provide a new and improved portable liquid fuel burner for cooking, for heating or for maintaining food hot at a point of service and having a canister construction which is simple and inexpensive to manufacture and easy to use.

Other objects of the invention will become apparent from time to time throughout the specification and claims as hereinafter related.

DESCRIPTION OF A PREFERRED EMBODIMENT

Figure 1:
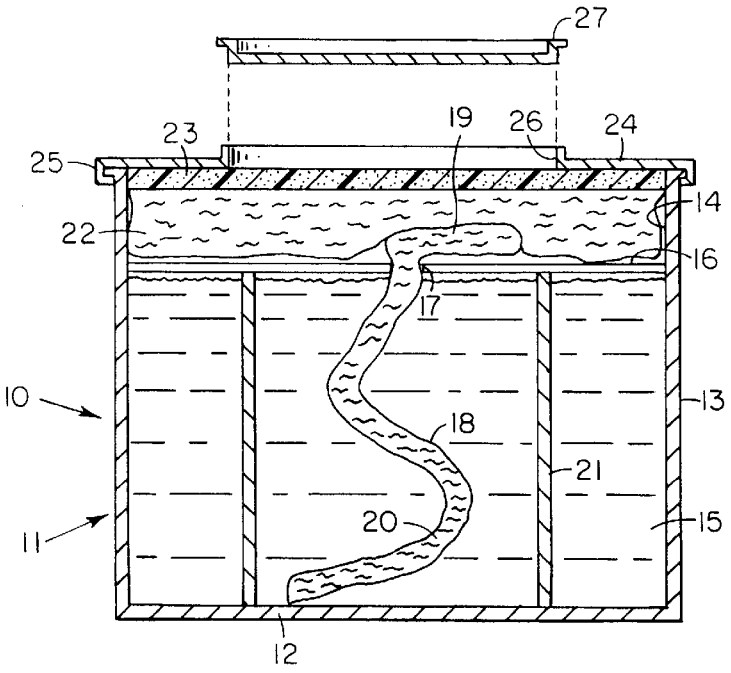
FIG. 1 is a vertical central sectional view of a disposable fuel burner illustrating one preferred embodiment of this invention.

Referring to the drawings by numerals of reference, there is shown in FIG. 1 a vertical central sectional view of a disposable fuel burner 10 which comprises container 11 having a closed bottom wall 12, an enclosing sidewall 13 and an open top 14. Container 11 is at least partially filled with a jellied or liquid fuel 15, preferably a relatively non-volatile fuel such as diethylene glycol or the like.

Figure 3:
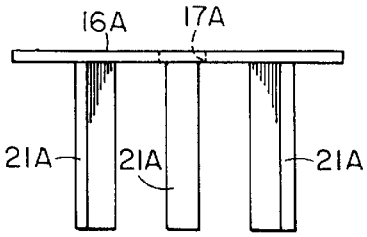
FIG. 3 is a view in side elevation of another embodiment of the internal support member for the disposable fuel burner of FIG. 1.
Figure 2:
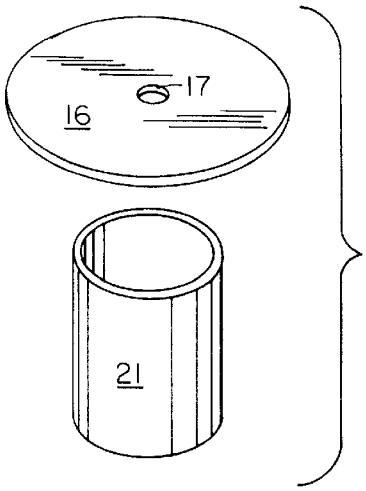
FIG. 2 is an exploded isometric view of the internal support members for the disposable fuel burner shown in FIG. 1.
Figure 4:
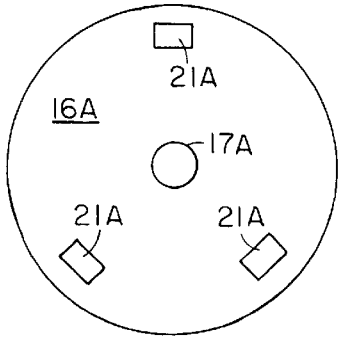
FIG. 4 is a top plan view of the support member shown in FIG. 3.

A support member 16 is supported adjacent the open top 14 above the level of the fuel 15, and defines a fuel chamber or cavity. Support member 16 has a centrally located opening 17 receiving one end of an elongated wick 18 of a fibrous material, e.g., cotton or glass fibers. The upper end 19 of wick 18 overlies support member 16 and the other end 20 is immersed in the fuel 15. Support member 16 is a cardboard disk supported on a cardboard cylinder 21. The support member may also be of a one-piece, molded-plastic construction as shown in FIGS. 3 and 4 where support member 16*a* has a central opening 17*a* and is supported on integrally formed legs 21*a*. Support member 16 may also be of aluminum or steel with a lip on the outer circumference thereof. When so constructed, support member is pressed into open top 14 of container 11 snug against sidewall 13. Support member 16 serves to support fiber bat 22 and to help prevent spillage of fuel 15 in case of accidental tip-over and allows a level flame to be maintained throughout the burn life of the fuel.

A porous fibrous layer or "bat" 22 of a refractory, non-combustible material, e.g., glass fibers or cotton, substantially fills the open container top 14 and overlies the support member and the end of the wick supported thereon. Its horizontal structure gives rise to a broad flame base, and as it overlies support number 16 it will keep the flame at the same level as fuel is consumed. Its porous nature allows fuel to migrate, under capillary action, to the surface thereof during use. A layer or "bat" 23 of a plastic, e.g., polyurethane, foam material overlies fibrous bat 22. A top wall member 24 cover is secured at its periphery 25 on container 11 closing open top 14. Wall member 24 has a central opening 26 which receives a removable cover 27.

The preferred fuel should be non-volatile, odorless, burn clean, and have a high flash point.

Operation

In use, cover or lid 27 is removed from container 11 to expose the portion of plastic foam bat 23 seen through opening 26. Fuel 15 is drawn by wick 18 to saturate fiber bat 22 and foam bat 23. The burner is ignited by a match or other lighter and flame is emitted uniformly from the entire opening 26. Plastic foam bat 23 slowly burns off with the burning fuel, leaving fiber bat 22 exposed. In subsequent operation, the flame is emitted from fuel carried by wick 18 to, and distributed uniformly over fiber bat 22.

Another Preferred Embodiment

Figure 5:
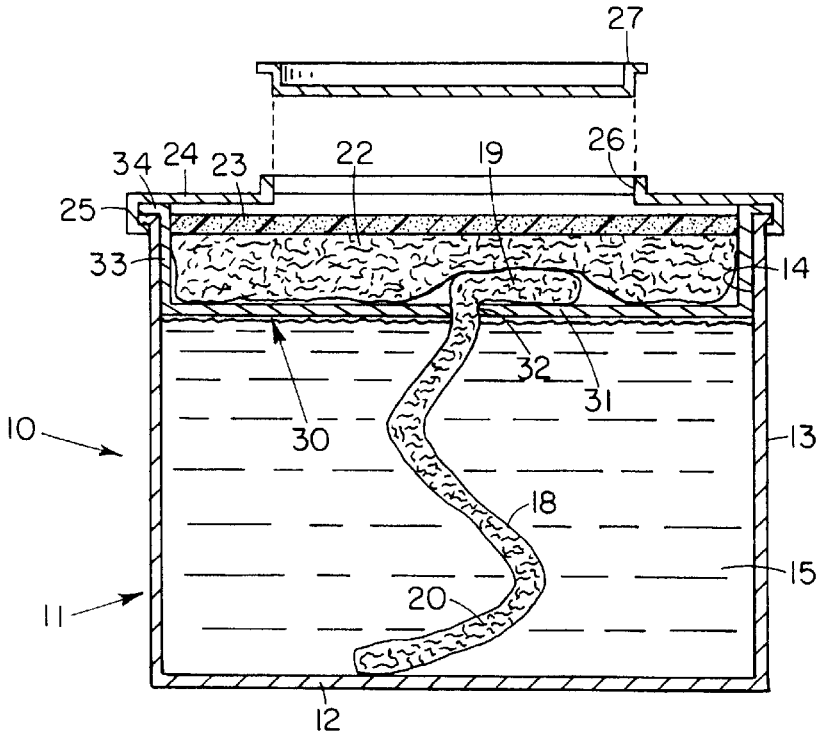
FIG. 5 is a vertical central sectional view of a disposable fuel burner illustrating another preferred embodiment of this invention.

Referring to the drawings by numerals of reference there is shown in FIG. 5 a view of another embodiment of the invention utilizing a different support for the fiber bat and foam bat. The structure is otherwise the same as that shown in FIG. 1 and like reference numerals are applied to like parts.

In FIG. 5, there is shown a vertical central sectional view of a disposable fuel burner 10 which comprises a container 11 having a closed bottom wall 12, an enclosing sidewall 13 and an open top 14. Container 11 is at least partially filled with liquid fuel 15 preferably a relatively non-volatile fuel such as diethylene glycol or the like.

A flat cup-shaped support member 30 (replacing support member 16) is supported adjacent the open top 14 above the level of the liquid fuel 15. Support member 30 has a flat bottom wall 31 with centrally located opening 32 receiving one end of an elongated wick 18 of a fibrous material, e.g., cotton or glass fibers. The upper end 19 of wick 18 overlies bottom wall 31 of support member 30 and the other end 20 is immersed in the liquid fuel 15. Support member 30 is a stamped sheet metal cup having a surrounding side wall 33 and is outwardly flanged at 34 to be supported on the upper end of container side wall 13.

A fibrous bat 22 of a refractory, non-combustible material, e.g., glass fibers, polyester or cotton fibers, substantially fills the open container top 14 and overlies the support member and the end of the wick supported thereon. A bat 23 of a plastic, e.g., polyurethane, foam material overlies fibrous bat 22. A top wall member 24 cover is secured at its periphery 25 on container 11 closing open top 14. Wall member 24 has a central opening 26 which receives a removable cover 27.

Operation

The operation is as described for the embodiment of FIG. 1. Cover or lid 27 is removed from container 11 to expose the portion of plastic foam bat 23 seen through opening 26. Liquid fuel 15 is drawn by wick 18 to saturate fiber bat 22 and foam bat 23. The burner is ignited by a match or other lighter and flame is emitted uniformly from the entire opening 26. Plastic foam bat 23 slowly burns off with the burning fuel, leaving fiber bat 22 exposed. In subsequent operation, the flame is emitted from fuel carried by wick 18 and distributed uniformly over fiber bat 22.

Still Another Preferred Embodiment

Figure 6:
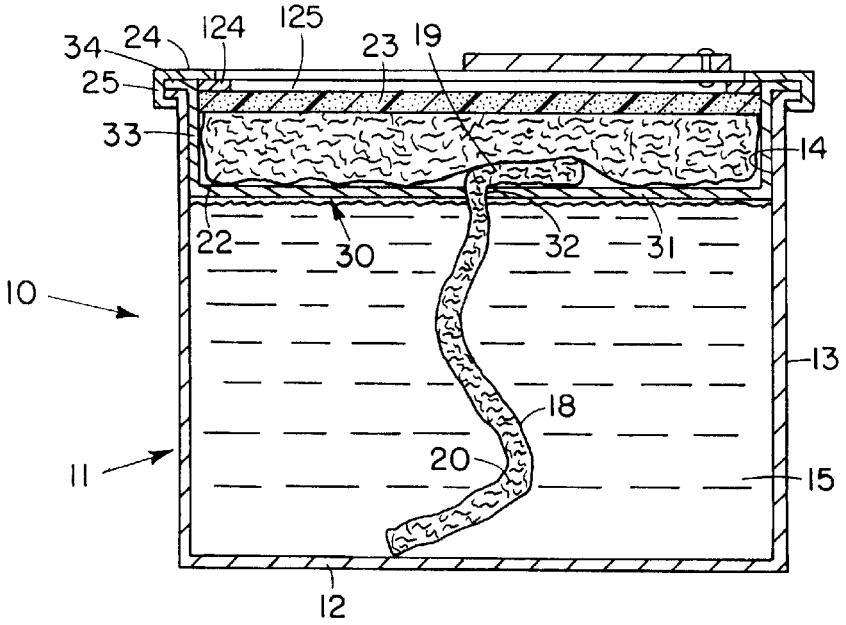
FIG. 6 is a vertical central sectional view of a disposable fuel burner illustrating another preferred embodiment of this invention having a pull-top construction.
Figure 7:
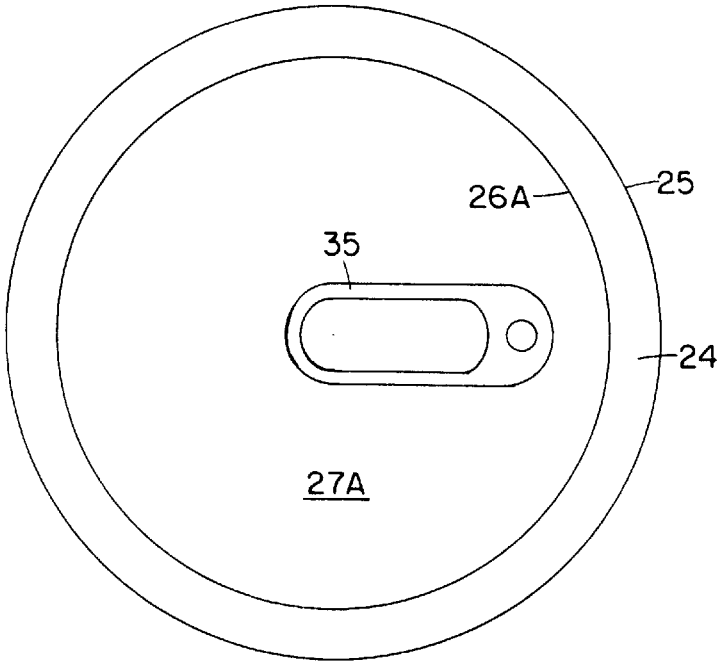
FIG. 7 is a top plan view of the disposable fuel burner shown in FIG. 6.

Referring to the drawings by numerals of reference, there is shown in FIGS. 6 and 7 a view of another embodiment the invention utilizing a different top opening. The structure is otherwise the same as that shown in FIG. 5 although this cover arrangement may be used with the embodiment of FIG. 1. In this embodiment, like reference numerals are applied to like parts.

In FIG. 6, there is shown a vertical central sectional view of a disposable liquid fuel burner 10 which comprises container 11 having a closed bottom wall 12, an enclosing sidewall 13 and an open top 14. Container 11 is at least partially filled with fuel 15, preferably relatively non-volatile fuel such as diethylene glycol or the like.

A flat cup-shaped support member 30 (replacing support member 16) is supported adjacent the open top 14 above the level of the liquid fuel 15. Support member 30 has a flal bottom wall 31 with centrally located opening 32 receiving one end of an elongated wick 18 of a fibrous material, e.g., cotton or glass fibers. The upper end 19 of wick 18 overlies bottom wall 31 of support member 30 and the other end 20 is immersed in the liquid fuel 15. Support member 30 is a stamped sheet metal cup having a surrounding side wall 33 and is outwardly flanged at 34 to be supported on the upper end of container side wall 13.

A fibrous bat 22 of a refractory, non-combustible material, e.g., glass fibers, polyester or cotton fiber, substantially fills the open container top 14 and overlies the support member and the end of the wick supported thereon. A bat 23 of a plastic, e.g., polyurethane, foam material overlies fibrous bat 22.

The top wall member 24 is secured at its periphery 25 on container 11 closing open top 14. Wall member 24 has a scored line of weakness 26*a* which defines a removable cover 27*a*. A pull-tab 35 is secured on cover 27*a* and is operable to remove the cover in the well-known manner. This pull-tab removable cover arrangement has been shown in connection with the embodiment of FIG. 5 but obviously can be used with the embodiment of FIG. 1 as well. A flat disc or ring member 124 with an opening 125 smaller than the opening 26*a* is provided to control the size of the flame and rate of burning. The burn rate can also be controlled by the size of opening 32 for wick 18. The length and density of the wick 18 also contributes to control of the size of flame and burn rate. All of these sizes may be predetermined for a particular application for the burner.

Operation

The operation is as described for the embodiments of FIGS. 1 and 5. Cover or lid 27*a* is removed from container 11 by pull-tab 35 to expose foam bat 23 across the entire opening. As in the other embodiments, fuel 15 is drawn by wick 18 to saturate fiber bat 22 and foam bat 23. The burner is ignited by a match or other lighter and flame is emitted uniformly from the entire opening 26. Foam bat 23 slowly burns off with the burning fuel, leaving fiber bat 22 exposed. In subsequent operation, the flame is emitted from fuel carried by wick 18 and distributed uniformly over glass fiber bat 22.

Still Another Preferred Embodiment

Figure 8:
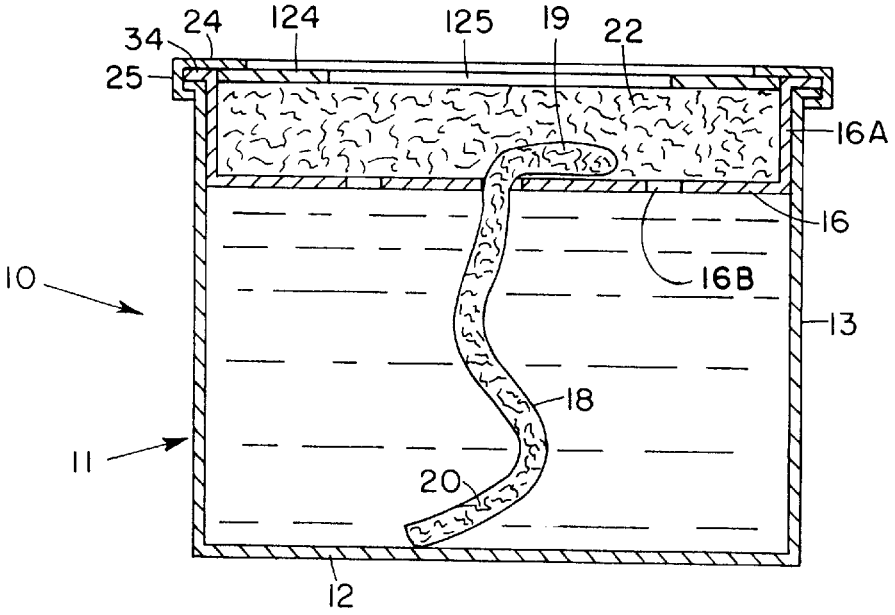
FIG. 8 is a vertical central sectional view illustrating another preferred embodiment of this invention.

FIG. 8 discloses still another preferred embodiment of fuel burner 10. In this embodiment, support member 16 acts to separate the fuel from the fibrous layer 22 and helps prevent liquid fuel 15 from spilling out in case of an accidental tip-over. Top wall member 24 is removed from FIG. 8 for the sake of illustration.

As can be seen in FIG. 8, fibrous layer 22 overlies support member 16. Support member 16 is held in place due to friction between support member edges 16*a* and enclosing sidewalls 13. Upper end 19 of wick 18 rests on support member 16 which support member contains breathing holes 16*b* therein. The function of breathing hole 16*b* is to prevent vacuum induced leakage or starvation of fuel 15 during the operation of fuel burner 10, while fuel 15 is consumed through wick 18. Breathing holes 16*b* allow equalization ambient pressure and internal pressure on fuel 15. Breathing holes 16*b* are sufficiently large to allow pressure equalization, but small enough to prevent the excessive or free flow of fuel 15 therethrough.

As can be seen in FIG. 8, upper end 19 of wick 18 overlies support member 16 and underlies or is otherwise in contact with fibrous layer 22. Fibrous layer 22 is made up of a material whose absorptive characteristics allow it to be soaked with a liquid or a jellied fuel and whose capillary action is efficient in delivering fuel to a burning surface on the top surface thereof and also for preventing a liquid or jellied fuel from spilling from fuel burner 10 during accidental tip-over. The fibrous bat may be made up of nylon, a polyester blend of nylon, or cotton. It must be porous with good absorption qualities and should not smoke when it burns. It functions to bring the fuel to the air and also to impede the flow of liquid or gelatin fuel. Conventional wicks spill fluid because their very efficient capillary action, when combined with the pull of gravity on a fuel allows the fuel to leak out and a fire to spread. However, a fibrous bat, when made up of the materials with the qualities set forth above and are used in the manner described herein, functions to both burn efficiently and prevent accidental spillage of the fuel in case of tip-over.

In the other preferred embodiments, fibrous layer 22 has been referred to as a bat made up of a refractory, non-combustible material, e.g. glass fibers. However, in preferred embodiment illustrated in FIG. 8, fibrous layer 22 may be made up of any material which contains sufficient porosity, permeability, and loft to allow it to retain liquid or jellied fuel at the same having capillary characteristics sufficient to transport the fuel to the outer surface thereof for combustion.

It can be seen then that the use of fibrous layer 22 with such characteristics allows the operator of liquid burner 10 to be free of the worry of having fire spread during accidental tip-over.

Ring member 124 fits snugly against sidewalls 13 and contains therein opening 125. Varying size of opening 125 allows operator to control the surface area from which the heat propagates and therefore to control the length of burn and the amount of heat per unit time emitted by fuel burner 10. Ring 124 also serves to locate and fix fibrous layer 22 between support member 16 and the top opening of container 12.

Igniter layer 23 is not illustrated in FIG. 8, but may be used with this embodiment in the same manner it is used in the aforedisclosed embodiments.

Still Another Preferred Embodiment

Figure 9:
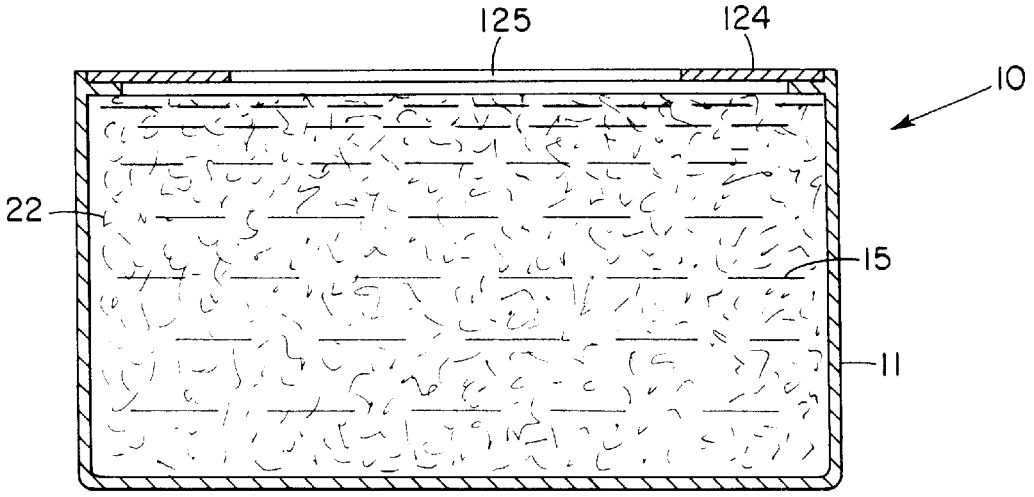
FIG. 9 is a vertical central sectional view illustrating another preferred embodiment of this invention (Same as FIG. 8).

FIG. 9 refers to yet another preferred embodiment. This wickless embodiment contains only fibrous layer 22 soaked with fuel 15 and held in container 11 by ring member 124. The characteristics of the material comprising fibrous layer are the same as that set forth for FIG. 8 above and present the accidental spillage of fuel 15.

Still Another Alternate Embodiment

FIGS. 10, 10*a*, 10*b*, and 10*c* illustrate another embodiment designed to give the user a means to support a cooking pan or dish while controlling the air supply to the flame of disposable burner 10.

This embodiment contains support means 58 removable attached to container 11 by means of lock tabs 66 and lock knobs 68. Support means 58 consist of a cylindrical sleeve 60 with an open top 61 and open bottom. The diameter of sleeve 60 is slightly greater than that of container 11 so sleeve 60 will fit therearound. Sleeve 60 is constructed of aluminum, steel, or other durable, lightweight non-combustible material.

Sleeve 60 has vent holes 62 therethrough and draft control tongue 64 thereon, the latter capable of being lifted open or closed flush with sleeve 60 to control the amount of air getting to the flame.

On the inside surface 63 of sleeve 60 are located lock tabs 66 which project inward to mate with lock knobs 68 which are located along vertical lines radially around sidewall 13. Thus, when lock tabs 66 and lock knobs 68 are so engaged, support means 58 is integral with container 11.

Figure 10:
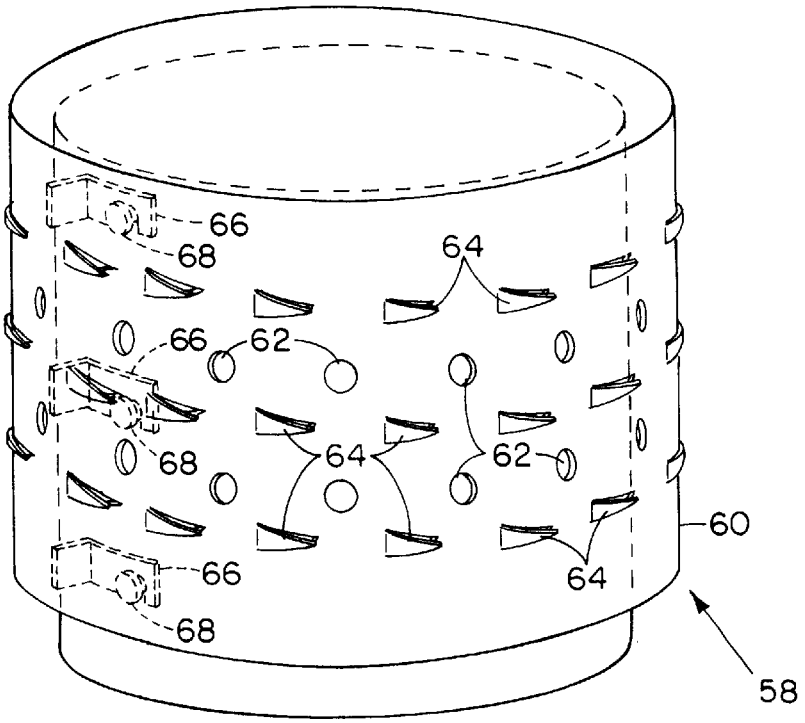
FIG. 10 is a perspective view of another embodiment illustrating support means.
Figure 10C:
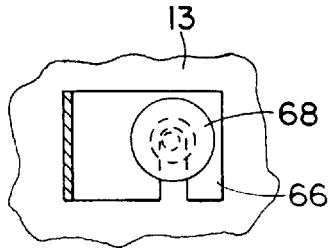
FIGS. 10*a,* 10*b,* and 10*c* illustrate features of the embodiment as illustrated in FIG. 10.
Figure 10B:
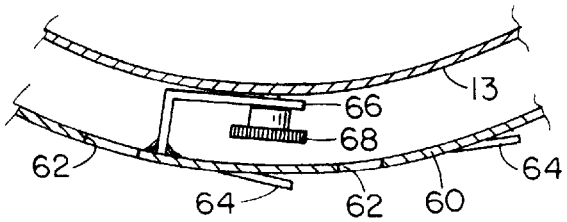
Figure 10A:
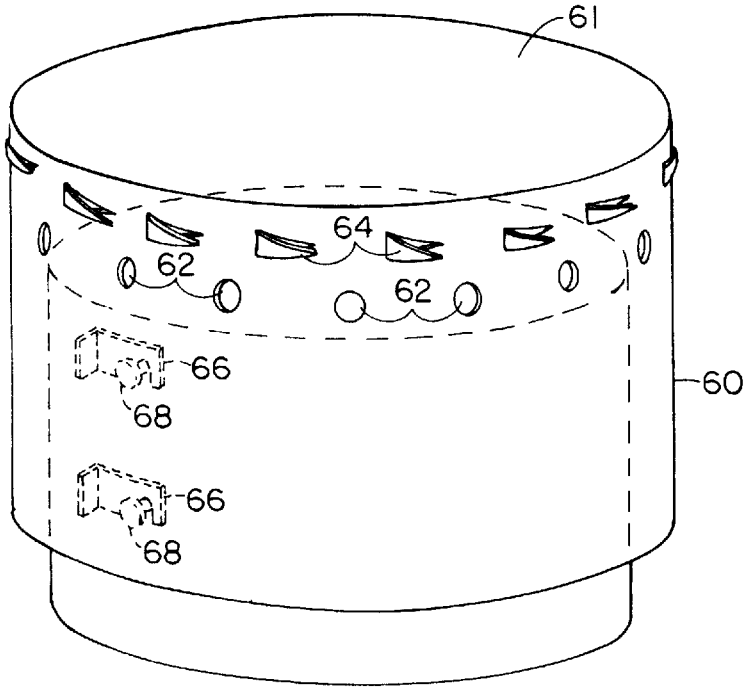

Vertical rows of lock tabs 66 correspond to vertical rows of lock knobs 68 as shown in FIG. 10. In use, operator rotates and raises sleeve 60 from its position as shown in FIG. 10 to that in FIG. 10*a*. Rotation is required for lock tabs 66 to clear lock knob 68. After aligning the bottom row of lock tabs 66 with the middle row of lock knobs 68, sleeve 60 is rotated so two rows engage. This locates support means 58 at an intermediate level. The operator may choose a higher level to cook at, depending upon his needs, wherein the bottom row of lock tabs 66 will engage the top row of lock knobs 68.

Thus, support means 58 function to hold the cooking dish or pan at adjustable levels with respect to the flame, and to control the amount of air to the flame.

Operation

The preferred embodiments illustrated in FIGS. 8, 9, and 10 are operated in substantially the same manner as set forth for those previously described. In reuse of fuel burner 10, fibrous layer 22 may be tufted up for ease in relighting.

The preferred fuel for all of the above described embodiments is diethy-lene glycol. This fuel is stable, non-hazardous (Department of Transportation), and odorless, with a low evaporation rate and negligible vapor pressure. The use of the relightable fibrous layer 22 insures a broad base to the flame and a constant flame level as well as the substantially complete use of fuel.

The preferred embodiments set forth above come in four (cylindrical) sizes (all in millimeters): 307×206, 208×208, 307×206 and 208×107. The following data is from tests done on preferred embodiment described in FIG. 8.

The 307×206 can produces about 5.5 hours of burn time per can and is used for standard buffet chafing dishes.

The 208×208 size is also used for regular buffet applications and yields about 4.5 hours burn time per can.

The 307×206 can is used primarily in room service and as a coffee warmer, and yields about 2 hours per can burn time.

The 208×107 can is used primarily for outdoor buffets, camping, single holder chafing dishes and hot boxes, and yields about 2.5 hours burn time per can.

While this invention has been described fully and completely, with special emphasis on certain preferred embodiments, it should be understood that, within the scope of the appended claims, the invention may be practiced otherwise than as specifically described herein.

We claim:

1. A disposable fuel burner comprising:

a container having a closed bottom, an enclosing sidewall and an open top;

a liquid fuel at least partially filling said container;

a support member positioned above said liquid fuel, said support member having a wick opening, said support member being generally flat and being supported adjacent said open top by peripheral contact with said enclosing sidewall of said container;

a wick of fibrous material having a first end immersed in said liquid fuel and extending through said wick opening;

a bat of fibrous material positioned adjacent said open top and supported by said support member, said bat contacting said wick extending through said wick opening;

means for retaining said liquid fuel in said container in case of accidental tip-over, said means for retaining said liquid fuel also serving as a wick means, said means for retaining said liquid fuel substantially filling said container and retaining said liquid fuel within voids dispersed within said means for retaining, and igniter means, said igniter means located on a top surface of said means for retaining said liquid fuel, said igniter means to ignite said liquid fuel when said igniter means is lit by an external energy source, said igniter means being substantially consumed by combustion during ignition.

2. A disposable fuel burner comprising:

a container having a closed bottom, an enclosing sidewall and an open top;

a diethylene glycol fuel;

a divider defining a fuel chamber within said container, said divider having a wick opening for receiving a wick therein and capable of supporting a porous layer thereon, wherein said divider further comprises a vent, said vent for substantially equalizing pressure between the atmosphere and said fuel chamber to prevent a pressure induced flow of excess fuel from said fuel chamber;

said porous layer comprised of a fibrous cotton layer, located atop and substantially parallel to said divider, said porous layer for feeding said fuel to the atmosphere for combustion therewith and further for retaining said fuel during tip-over of said container;

said wick having a first end in said fuel chamber in contact with said fuel and having a second end extending through said wick opening onto an upper surface of said divider, said second end of said wick in contact with said porous layer for feeding fuel thereto;

an igniter, alcohol doped and located atop said porous layer for assisting the ignition of said fuel, wherein said fuel burner is lit by heating said igniter to combustion with an external heat source, said igniter being substantially consumed while igniting said fuel; and a ring member, located atop said porous layer and in contact therewith, having an outer circumference substantially in contact with said sidewalls of said container and having an inner circumference defining a burn opening, the diameter of said burn opening controlling a flame size, a rate of fuel consumption and a heat output of said burner.

3. A disposable fuel burner comprising:

a container having a closed bottom, an enclosing sidewall and an open top;

a liquid fuel at least partially filling said container;

a support member positioned above said liquid fuel having a wick opening, said support member being generally flat and being supported adjacent said open top by peripheral contact with said container;

a wick of fibrous material having a first end immersed in said liquid fuel and extending through said wick opening; and a bat of fibrous material positioned adjacent said open top and supported by said support member, said bat contacting said wick extending through said wick opening.

4. A disposable fuel burner comprising:

a container with an enclosing sidewall, a closed bottom, and an open top;

a divider defining a fuel chamber within said container, said divider having a wick opening for receiving a wick therein and capable of supporting a porous layer thereon;

said porous layer located atop and substantially parallel to said divider for feeding a fuel to the atmosphere for combustion therewith; and said wick having a first end in said fuel chamber in contact with said fuel and having a second end extending through said wick opening onto an upper surface of said divider, said second end of said wick in contact with said porous layer for feeding fuel thereto;

wherein the combination of said container, said divider, said wick and said porous layer support the combustion of fuel across a top surface of said porous layer during normal use and substantially prevent spillage of said fuel during accidental tip-over.

* * * * *